United States Patent [19]

Krause et al.

[11] 4,167,861

[45] Sep. 18, 1979

[54] FLATBED KNITTING MACHINE INCLUDING CONTROL DATA CONVEYING MEANS

[75] Inventors: Erich Krause; Hans Schieber, both of Bopfingen; David Retallick, Gillching; Albin Weingartner, Munich, all of Fed. Rep. of Germany

[73] Assignee: Universal Maschinenfabrik Dr. Rudolf Schieber KG, Westhausen, Fed. Rep. of Germany

[21] Appl. No.: 862,886

[22] Filed: Dec. 21, 1977

[30] Foreign Application Priority Data

Dec. 23, 1976 [DE] Fed. Rep. of Germany ..... 2658588

[51] Int. Cl.[2] ..... D04B 7/00; D04B 15/66

[52] U.S. Cl. ..... 66/75.2; 66/232

[58] Field of Search ..... 66/154 A, 75.2; 360/129

[56] References Cited

U.S. PATENT DOCUMENTS

| | | | |
|---|---|---|---|
| 2,886,652 | 5/1959 | Davis | 360/129 |
| 2,923,779 | 2/1960 | Namenyi-Katz | 360/129 |
| 2,927,974 | 3/1960 | Stovall | 360/129 |
| 2,945,216 | 7/1960 | Gyger et al. | 360/129 |
| 3,760,610 | 9/1973 | Hadam et al. | 66/154 A |
| 3,783,642 | 1/1974 | Hadam et al. | 66/75.2 |
| 4,055,058 | 10/1977 | Tewsley | 66/154 A |

FOREIGN PATENT DOCUMENTS 2114127 10/1972 Fed. Rep. of Germany .

*Primary Examiner*—Ronald Feldbaum
*Attorney, Agent, or Firm*—Sughrue, Rothwell, Mion, Zinn and Macpeak

[57] ABSTRACT

In a flatbed knitting machine having one or more carriages movable reciprocally or, on a closed path with respect to one or two needle beds, control data is conveyed to the or each carriage by light or other electromagnetic radiation or acoustically, one or more data transmitters being located externally of the needle bed or beds and the carriage having means for processing and storing data relating to at least one knitting course. The transmission zone is screened or otherwise shielded against interference. The transmitted signals may be modulated in various ways and alarm and timing control arrangements are described.

32 Claims, 20 Drawing Figures

FLATBED KNITTING MACHINE INCLUDING CONTROL DATA CONVEYING MEANS

The transmission of data from stationary data carrier to movable parts such as the carriages of a knitting machine poses considerable problems. In flatbed knitting machines, a trailing cable is usually employed, over which data in the form of already amplified pulses are transmitted. Such a trailing cable, if it is mechanically satisfactory, is difficult and costly to produce and because of the degree and high frequency of bending, it suffers heavy wear in service. Furthermore the trailing cable must be well screened since otherwise it picks up electrical fields present in the vicinity as interference and reproduces them as noise pulses.

In flatbed knitting machines with circulating carriages a trailing cable for the transmission of data cannot be employed at all. The employment on the carriages, of sliding contacts which run on stationary sliding surfaces, is not suitable for the transmission of data, since control signals transmitted over the sliding contacts are frequently distorted or modified by the transmission itself. Over sliding contacts, therefore, only essentially constant currents rather than pulses to be processed durther as data can be transmitted without interference. This is true above all for machines located in a knitting shop where one must reckon with flock and fluff flying about in the shop.

A device of the kind in question has therefore become known in which the transmission of the data from a stationary data carrier to the movable carriage of the flatbed knitting machine is effected without a wired connection. During the passage of the carriage the data are transmitted through the needle space in times coordination with the advance of the carriage. The transmission is effected by means of electromagnetic waves via an antenna situated within range of the knitting machine being controlled, by a modulated carrier frequency system. Since the rooms in which textile machines are used normally contain considerable electrical interference the danger always exists of the data being transmitted incorrectly. Further, where multi-channel techniques are employed the known device has cross-talk problems and a high susceptibility of interference by electromagnetic fields; it moreover requires large sized transmission parts such as coiles and wire loops. Finally the frequency allocation for such data transmission is different in every country, and additional difficulties arise from this.

An object of the invention is to provide a flatbed knitting machine in which data is transmitted substantially without interference.

It is also an object of the invention to provide data transmission arrangements for a flatbed knitting machine which minimizes interference by means of acoustic data tranmission.

A further object of the invention is to employ light signals for data transmission in a knitting machine to minimize the effect of external influences.

A still further object of the invention is to facilitate control of a flatbed knitting machine by use of signals comprising a modulated carrier wave.

Yet another object of the invention is to minimize interference in data transmission in a knitting machine by providing transmission means between a transmitter and a receiver.

An additional object of the invention is to minimize operational discruption of a knitting machine by providing means for diversion of control data from defective to non-defective carriages.

The invention has additionally the object of providing means capable of fulfilling the foregoing object in a reliable and economical manner.

SUMMARY OF THE INVENTION

In accordance with the invention, a knitting machine has a movable carriage with a receiver, a needle actuating device, and means for processing and storing received data for controlling the actuation device through at least one course of knitting, the data being transmitted from a transmitter located outside the region occupied by the needle. The transmission region in which data transmission is effected is advantageously screened or shielded against interference.

The invention thus makes it possible to receive data for at least one course of knitting without the use of wires, to store, process, and amplify the data and to reproduct it for control of electromechanical needle actuating parts in co-ordination with the passage of the carriage across the needles. Data transmission can be effected during the passage of the receivers past the transmitters one after another.

The distance between transmitter and receiver during data transmission is advantageously brought to a minimum by transmission media. A further reduction in sensitivity of the apparatus to disturbance thereby results.

The electronic means necessary to the reception and processing of the data and to control of the needles comprises, for example, convertors, amplifiers, pulse generators and processing units.

In order to minimize outlay on electronic components for processing the data on the carriage, a microprocessor can be provided on each carriage. To avoid heavy outlay on the synchronization of the carriages with one another, a pulse generator is advantageously provided on each carriage, which generates a pulse at each step from one needle to the next.

So that the date is transmitted in an advantageous physical form, a converter is advantageously connected before the transmitter, which converts the data stored electronically in the data carriers into an appropriate form for transmission, whilst a converter is associated with the receiver to convert the signals received into electrical pulses.

To minimize the number of transmitters and receivers, data items are advantageously transmitted one after another from the transmitter to the receiver while the receiver is moving along a portion of its path in the transmission region of the transmitter, this portion being only part of the total path which the receiver covers.

The supply of operating current to the carriages particularly in flatbed knitting machines which have circulating carriages, is advantageously effected by sliding contacts on each carriage.

Complete exclusion of electromagnetic interference is possible if the transmitters contain light sources and the receivers photoelectric cells for optical transmission of data.

If even the limited interference which occurs with light transmission must be avoided, the transmitters and receivers may contain means for acoustic transmission of data.

In order to prevent errors in transmission from occuring through obstruction by dirt of the transmission members, the transmitters and receivers may have means for screened directional transmission of electromagnetic data. In this case the transmission of data is effected in such a way that the electromagnetic radiation is exactly aligned with the receivers.

To achieve asymmetrical concentration with optical transmission, lenses are advantageously associated with the light sources of the trnsmitter and further lenses are provided in front of the photoelectric cells of the receivers. Alternatively mirrors may be associated with the light sources of the transmitters and lenses provided in front of the photoelectric cells of the receivers.

Each transmitter can moreover be connected to a light-bar, the light-bar having the smallest possible clearance from the receivers in the transmission region that the mechanical construction permit. Also, each transmitter may be connected to a bundle of glass fibres the ends of which remote from the transmitter are arranged along an elongated region for parallel light emission in the transmission region. By this means parallel light entry into the receiver is ensured.

Where light transmission takes place in air, and a plurality of channels are each associated with a respective transmitter, opaque partitions are advantageously provided in the transmission region between the channels. By this means, with the use of multi-channel techniques, the effects of each individual channel on the others is minimized. The edges of the partitions next to the receivers advantageously extend parallel to the directions of motion of the receivers.

Again, with optical transmission the light source and the light receiver can be accommodated centrally in respective associated electronic units and connected by respective light-cables to a transmission point and a reception point.

To increase the security of data transmission by optical or acoustic means, members may be provided on the carriages for cleaning the transmitters and stationary members for cleaning the receivers. Such members may be fixed or rotating brushes.

When the data is transmitted electromagnetically there may be associated with each transmitter, in the transmission region, a wire loop as antenna, past which moves the associated receiver with a ferrit rode as antenna.

Alternatively, a metal rod in the transmission region may be associated with each transmitter as antenna, past which the associated receiver moves with a probe as antenna.

The transmission of the data by different physical means may also be effected by means of different types of transmission. Thus each transmitter may be switched on and off at each transmission of signals so as to emit an unmodulated radiation. Also, each transmitter may transmit a carrier frequency at intervals, in which case it is either switched on and off, or the carrier frequency is modulated, and the associated receiver selectively tuned in to the transmitter so as to respond only to the carrier frequency; nstead the associated receiver may be connected in an oscillating circuit or provided with an active filter which reacts to a definite frequency.

In another type of transmission, the transmitter transmits a modulated carrier frequency either in sinewave form or in pulse operation, and the associated receiver contains an oscillating circuit responding to the frequency, an active filter or a phase locked loop, which determines the selectivity of the receiver.

The transmitter can further trasnmit data in a definite rhythm, the associated receiver introducing expressly generated timing signals.

An additional channel may be provided for the transmission of timing signals, each transmitter making the associated receiver ready for reception by a timing signal, and the receiver acknowledging via another timing channel. In this way the transmission of the data may be effected asynchronously.

For saving storage capacity on the carriages, in flatbed knitting machines in which the carriages move to and fro, transmitters may be provided at both points of reversal of the carriage for the transmission of data to the associated receivers for one course of knitting in each case for each knitting system present on the carriage.

In another embodiment of the invention a flatbed knitting machine has carriages which move to and fro, a transmitter being provided at only one of the points of reversal of the carriage for transmission of data to the associated receiver for one course of knitting for each knitting system present on the carriage. With such a system there is a saving in number of transmitters.

In the case of flatbed knitting machines having carriages which circulate, it is possible to operate on both knitting heads with different data without increased storage capacity by providing transmitters between the knitting heads for the transmission to the associated receivers at each passage thereof of data for one course of knitting for one knitting head.

If on the other hand storage capacity is to be saved on the carriages, flatbed knitting machines having carriages which circulate, transmitters are provided at the cam racking points for the transmission at each passage of the associated receivers on the carriages of data relating to one course of knitting for both knitting heads.

In a further embdoiment of the invention, an alarm device with a transmitter is provided on each carriage which device can be switched on automatically or by hand if a defect occurs on the carriage to transmit to the data carrier a signal which prevents the transmission of data to the defective carriage; the transmitter on the data carrier holds back these data and transmits them to the next succeeding non-defective carriage. By this means, extended standstill times through defective carriages and disturbances of the cycle in the development of the pattern are avoided in flatbed knitting machines having carriages which circulate.

BRIEF DESCRIPTION OF THE DRAWINGS

In FIG. 1, a flatbed knitting machine 1 with a stationary data store of carrier 2 is shown diagrammatically. The data-carrier 2 operates on transmitters 3 which are located outside a zone 4 in which cams on the carriage 6 of the machine can actuate its needles. The transmitters 3 transmit data along the length of a transmission region 5 through which runs the carriage 6 on which receivers 7 are mounted. A marker 8 is provided on the carriage 6 and a sensor 9 on the data-carrier 2. When the marker 8 moves past the sensor 9 the latter emits a pulse to an electronic transmission device 10 which is equipped with a microprocessor and other electronic units necessary to the processing of data.

In FIG. 2 the electronic arrangements of the data-carrier 2 and the carriage 6 are shown in a block diagrammatic form.

Figure 1:
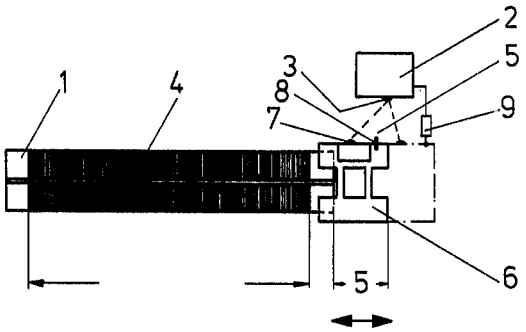
FIG. 1 is diagrammatic plan view of a flatbed knitting machine with a stationary data-carrier and its transmitter as well as of the receiver on the carriage.
Figure 2:
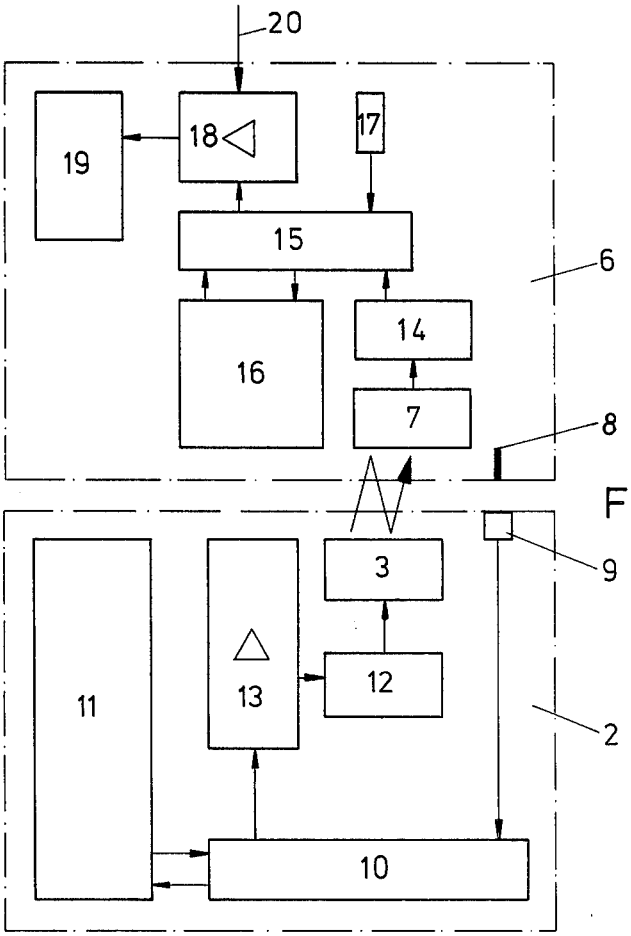
FIG. 2 shows electronic devices on the carriage and the data-carrier of FIG. 1 in block diagram form.

The data store 2 contains the electronic transmission device 10 which prior to receiving a pulse from the sensor 9 extracts data for the next course o row of knitting from a data store 11 and stores it temporarily. Upon the arrival of a pulse from the sensor 9 the electronic transmission device 10 passes this data to an amplifier 13. Next, the data is supplied to a converter 12 which converts it into the physical form in which it is to be transmitted. The converter 12 repeats the data to the transmitter 3 which transmits the data in the sequence determined by the electronic transmission device into the transmission region 5 to the receiver 7 on the carriage 6.

The receiver 7 passes on the received data to the units provided on the carriage 6. The data first goes to a converter 14 which converts it into suitable electrical pulses which are fed via an electronic control equipment 15, likewise equipped with a microprocessor, and the electronic units necessary to the data processing, to a store 16. In the store 16 all the data necessary to the performance of the next knitting process are stored for all of the control or actuating systems on the carriage 6 for one course or row of knitting, until the carriage 6, with its cam extending ahead of it, has reached the needle space 4.

On the carriage 6 there is also provided a pulse generator 17 which as soon as the carriage has reached the needle space emits pulses in time with the forward motion from one needle to the next, to the electronic control equipment 15. The latter reads the data from the store 16 and passes this on to an amplifier 18 from which the amplified pulses are repeated to an electromechanical control device 19 for controlling the needles.

Operating current is fed to the units on the carriage 6 through a feeder 20. The supply of operating current, particularly in the case of flatbed knitting machines having carriages which circulate, may be effected via sliding contacts on the carriage and corresponding slidebars on the machine frame. Where data is transmitted by electromagnetic waves, the converters 12 and 14 may be omitted. The electronic transmission equipment 10 then operates directly on the amplifier 12 and the receiver 7 directly on the electronic control equipment 15.

Figure 3:
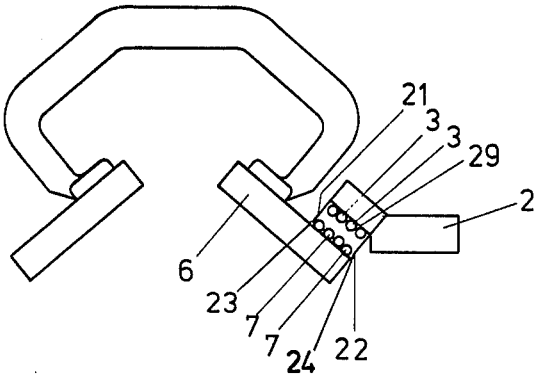
FIG. 3 is a side view of the carriage of a flatbed knitting machine and the stationary data-carrier with transmitters during the passage of the receivers through a protected transmission region.
Figure 4:
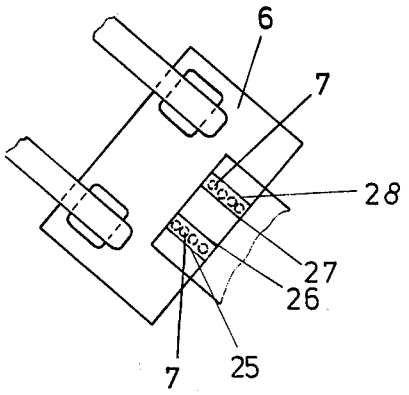
FIG. 4 is a plan view of the carriage and data-carrier of FIG. 3.

FIGS. 3 and 4 show a carriage and a data-carrier with special measures for the protection and screening of the transmission region against external influences. On both sides of the transmitter 3 two strips 21 and 22 extending in the direction of motion of the carriage 6 are fitted in such a way that their lower edges 23 and 24 remain close against the carriage 6 when this runs past. On the carriage 6, the receivers 7 are bordered by cross-strips 25, 26, 27 and 28 running transversely to the direction of movement of the carriage and extending upwardly, the top edges 29 running along against the data-carrier 2. If the data is transmitted by means of electromagnetic waves the strips 21 and 22 as well as the cross-strips 25, 26, 27 and 28 are of iron in order to form a Faraday cage upon the carriage 6 when passing through the transmission region. If the transmission of the data is effected, for example, optically or acoustically another material, e.g., a plastics material, may be employed.

Onto the edges 29 of the cross-strips 25, 26, 27 and 28 brushes or strips of felt may be fixed, which free the transmitter 3 from contamination each time they pass, whilst the receivers 7 as they pass by may be cleaned by rotating brushes. This cleaning of the transmission members is most advantageously provided in the case of optical and acoustic transmission of the data.

Figure 5:
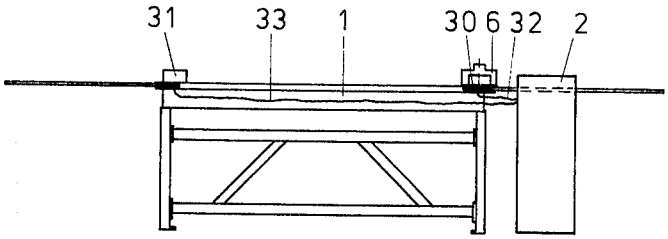
FIG. 5 is a front view of a flatbed knitting machine with a stationary data-carrier and a transmitter at each carriage reversal point.
Figure 6:
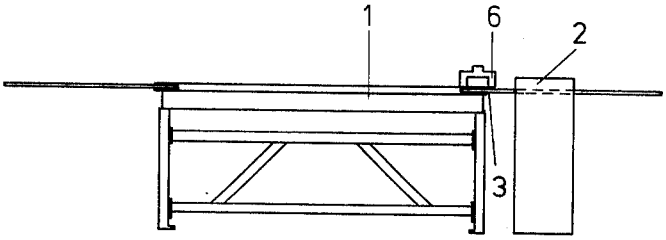
FIG. 6 is a front view of a flatbed knitting machine with a stationary data-carrier and a transmitter at only one reversal point.

FIGS. 5 and 6 represent flatbed knitting machines with different respective arrangements of the transmitter. In the machine of FIG. 5, data from the data-carriers on the machine is transmitted via transmitters containing transmission devices 30 and 31 on both sides of the machine, the supply to the transmission devices 30 and 31 being effected over screened cables 32 and 33. In the machine of FIG. 6, transmission of data from the data-carrier 2 to the carriage 6 is effected by means of a transmitter 3 provided only at the righthand side of the machine.

Figure 7:
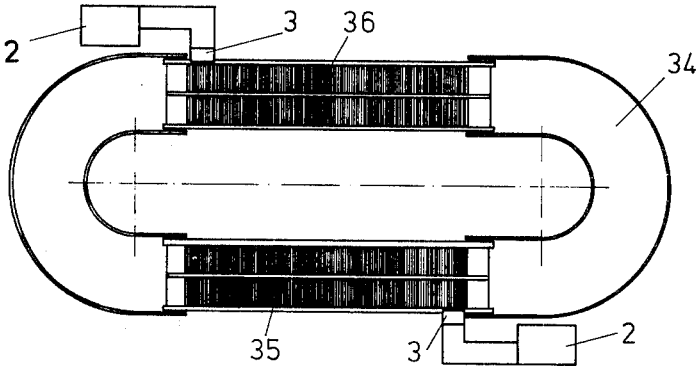
FIG. 7 is a plan view of a flatbed knitting machine having circulating carriages and transmitters in front each knitting-head.
Figure 8:
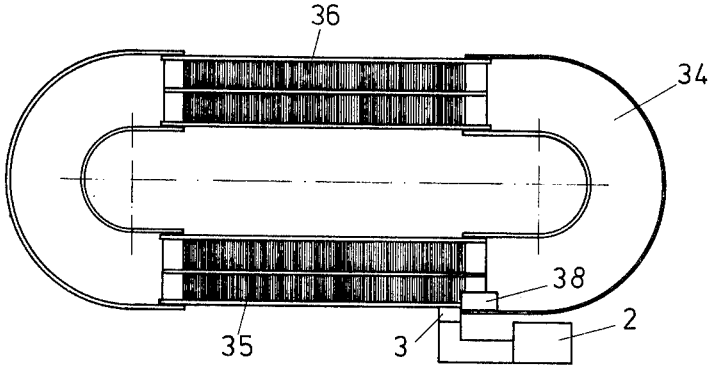
FIG. 8 is a plan view of a flatbed knitting machine embodying the invention, which has carriages which circulate and a transmitter at one cam racking point only.

In FIGS. 7 and 8 flatbed knitting machines are shown which have circulating carriages and different respective arrangements of the transmitters. FIG. 7 shows an embodiment in which a data-carrier 2 with a transmitter 3 is located before each needle array or knitting head 35 and 36 of the machine. FIG. 8 shows an embodiment in which a data-carrier 2 with a transmitter 3 is provided at only one cam racking point 38.

Figure 9:
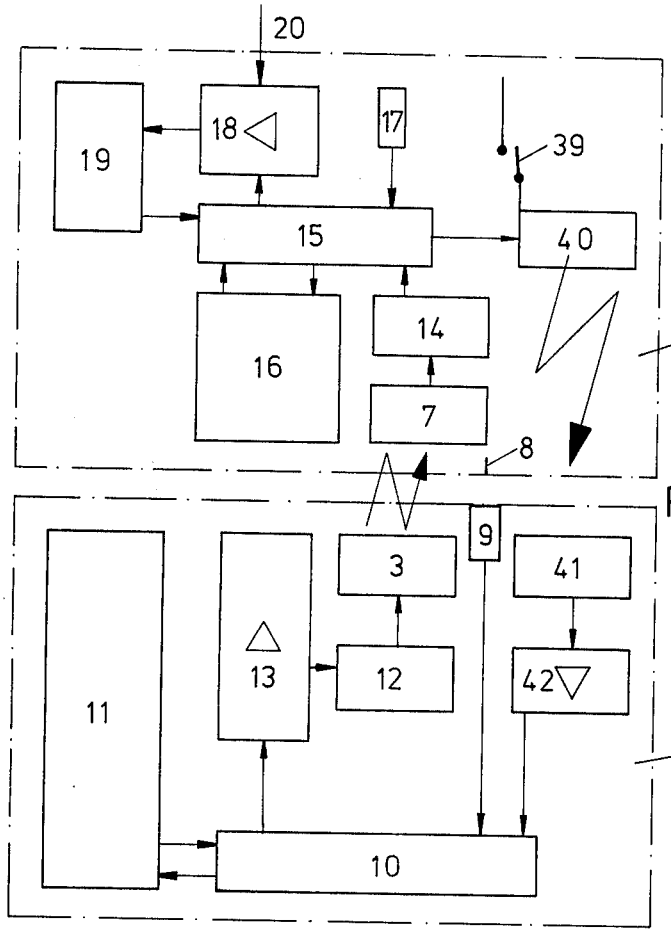
FIG. 9 shows electronic devices on a carriage and in a stationary data-carrier with an additional transmitter on the carriage and receiver on the data carrier, in a block diagram form.

In the case of a flatbed knitting machine such as the machine 34 of FIG. 8, which has carriages which circulate, stoppage of the machine because of one or a few defective carriages 6 has to be avoided. The data-carrier 2 and the carriages 6 are therefore extended with additional units as is shown in FIG. 9 in block diagram form. The electromechanical control device 19 on the carriage 6 is arranged in such a way that in case of a defect it repeats a signal to the electronic control equipment 15. Alternatively the operator may actuate a switch 39 by hand. In both cases an additional transmitter 40 provided on the carriage is switched on which, when it runs through the transmission region, transmits a signal to an additional receiver 41 provided on the data-carrier 2. The receiver 41 applies the signal via an amplifier 42 to the electronic transmission device 10. When such a signal arrives in the electronic transmission device 10, the output of data from it to the carriage 6 is blocked and the data is stored until the next non-defective carriage 6, on which the transmitter 40 is inoperative, has arrived with its marker 8 at the sensor 9. The delayed data is then transmitted to this intact carriage 6, so that the development of the cycle of the pattern is independent of the number of carriages 6 in circulation. Thus flatbed knitting machines having carriages which circulate around a closed path can carry on if one or more carriages 6 are taken away for repair.

Figure 10:
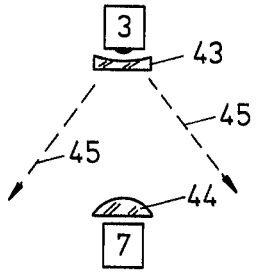
FIG. 10 shows an optical transmission device in which a lens is positioned between a transmitter and a receiver.
Figure 11:
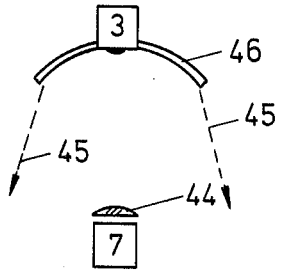
FIG. 11 shows an optical transmission device in which a mirror is associated with the light source and a lense is located in front of the receiver.

FIG. 10 shows an optical transmission device in which a lens 43 is positioned to receive light from the transmitter 3 and a lens 44 is placed in front of the receiver 7. By means of these lenses, light rays 45 which would otherwise go astray are directed above and below into the transmission region. Another arrangement for achieving the same object is shown in FIG. 11. Here a mirror 46 is associated with the transmitter 3, whilst a lens 44 is again connected in front of the receiver 7.

Figure 12:
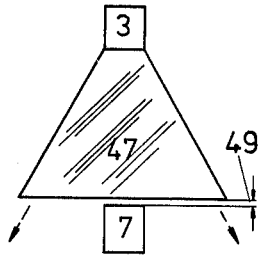
FIG. 12 shows an optical transmission device in which a light-bar is associated with the transmitter.

FIG. 12 shows a further optical transmission system in which a light-bar 47 is connected to the transmitter 3 for bridging across the distance between the transmitter and the receiver 7. The output side of the light-bar 47 moreover extends along the transmission region necessary to the transmission of the data. A gap 49 between the light-bar 47 and the receiver 7 is made as small as is possible, taking into consideration the mechanical construction and movement of the parts.

Figure 13:
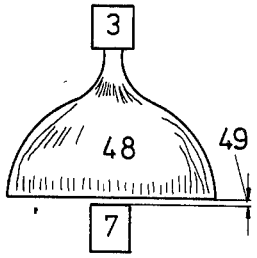
FIG. 13 shows an optical transmission device in which a bundle of glass fibres is associated with the transmitter.

FIG. 13 likewise shows an optical transmission device, but one in which a bundle of glass fibres 48 is connected between the transmitter 3 and the receiver 7. The description in connection with the gap 49 of the transmission device of FIG. 12 applies to the gap 49 here. The ends of the bundle of glass fibres 48 facing the receiver 7 are so arranged along the transmission region that the output of light from the glass fibres and the entry of light into the receiver 7 is effected in parallelism.

Figure 14:
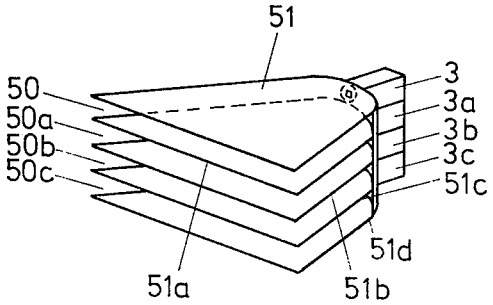
FIG. 14 shows an optical transmission device for a number of channels with partitions.

FIG. 14 shows an optical transmission device having a number of channels. On both sides of transmission spaces or channels 50 to 50*c*, in which transmitters 3 to 3*c* transmit, partitions 51 to 51*d* are fitted, with prevent the individual channels from mutually interfering. The edges of the partitions 51 to 51*d* next to the receivers extend parallel to the direction of motion of the carriage 6 as it runs past them.

Figure 15:
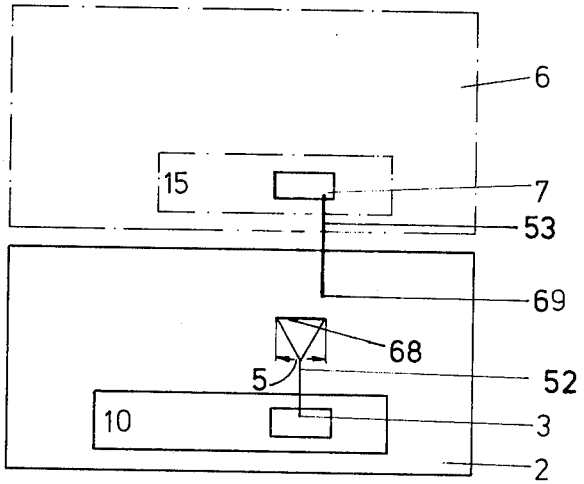
FIG. 15 shows an optical transmission device with a light source and photoelectric cells integrated into electronic units, and light-conductors extending from them.

With an optical transmission device, the transmitters 3 containing light sources and the receivers 7 containing photoelectric receivers, in particular photo-semiconductors, may also be integrated directly in each case into an electronic module in the associated electronic units, that is, the electronic transmission device 10 and the electronic control device 10 and the electronic control device 15. Such a device is illustrated in FIG. 15. From the transmitter 3 and from the receiver 7, light-conductors extend, which move relatively with their ends 68 and 69 facing one another across a small gap 49.

Figure 16:
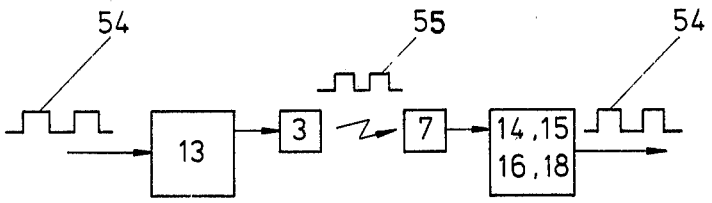
FIG. 16 diagrammatically shows representation of the transmission of data by the direct method.
Figure 17:
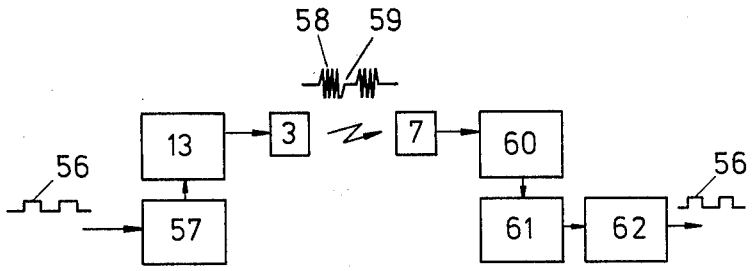
FIG. 17 diagrammatically represents transmission of data with amplitude modulation.
Figure 18:
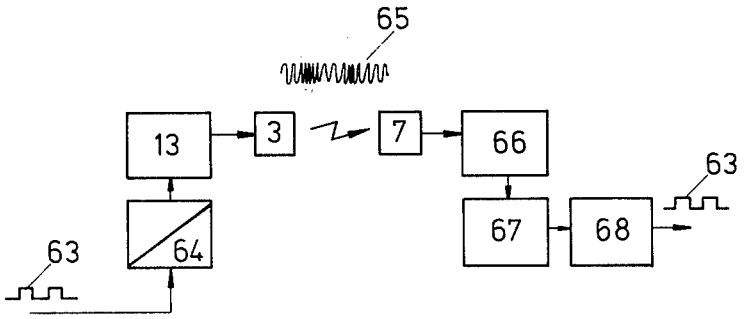
FIG. 18 diagrammatically represents transmission of data with frequency modulation.

All the general kinds of transmission described can be carried out in various different ways, for example, as in connection with FIGS. 16, 17 and 18, that is, the various signal control arrangements of these Figures can be applied to optical and acoustic transmissions as well as to transmission by electromagnetic radiation. In general, features of the different embodiments described can be interchanged as appropriate.

In the apparatus illustrated in FIG. 16, a pulse 54 is generated directly by switching on and off. This square wave pulse is amplified in the amplifier 13 and transmitted as a pulse 55 from the transmitter 3 to the receiver 7. From the receiver, it is fed via the converter 14 to the electronic control equipment 15 and thence passed on to the store 16 and to the amplifier 18. At the output from the amplifier 18 the form of the pulse 54 again appear.

In the apparatus illustrated in FIG. 17, a square wave pulse 56 controls an oscillator 57 amplitude modulating its output to a predetermined amplitude, the resultant output being amplified in the amplifier 13 and supplied to the transmitter 3. The transmitter 3 transmits the modulated pulses 58 with intervals 59 separating the signals to the receiver 7 from which the pulses 58 pass to an amplifier 60. At the output from the amplifier 60 a frequency selector 61 is provided, which responds only to a predetermined frequency, that of the oscillator 57, so as to let the pulses through to a demodulator 62. The demodulator 62 provides output pulses in the form of the pulses 56.

In the apparatus illustrated in FIG. 18 a pulse 63 is modulated in a frequency modulator 64 and supplied to the transmitter 3 via the amplifier 13. The transmitter 3 transmits the resulting frequency-modulated signal 65 to the receiver 7. The receiver 7 leads the signal to an amplifier 66 from which the signal is applied to a frequency selector 67. From the selector 67 only predetermined frequencies are applied to a demodulator 68. The demodulator 68 generates pulses corresponding to the pulse 63 from the predetermined frequencies.

Figure 19:
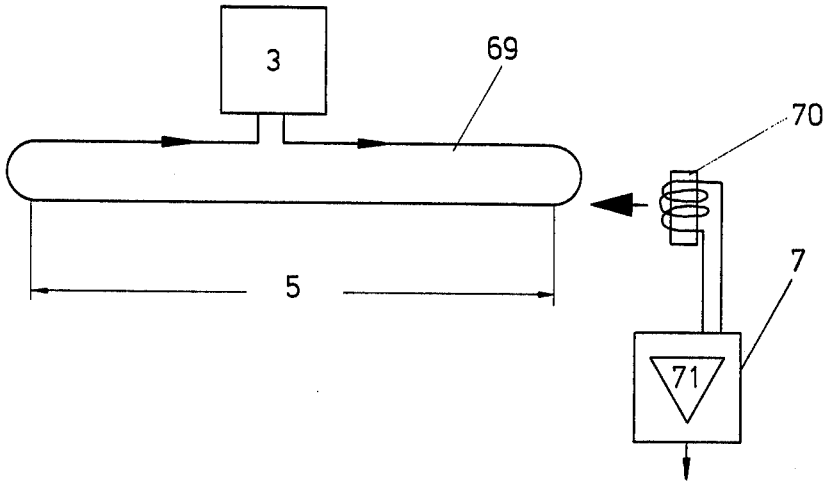
FIG. 19 diagrammatically represents transmission of data by inductive means.

In FIG. 19, an apparatus for inductive transmission of data by means of electromagnetic waves is illustrated. Provided on the transmitter 3, is a wire loop 69 which lies across the transmission region. This wire loop 69 acts as the transmission antenna. The receiver 7 runs past the wire loop 69 with a ferrite rod 70 as the reception antenna and passes on the pulses received via an amplifier 71.

Figure 20:
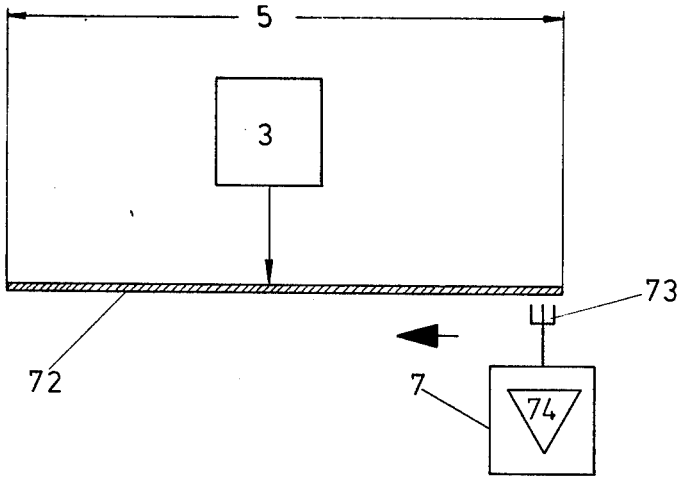
FIG. 20 diagrammatically represents transmission of data by capacitive means.

FIG. 20 shows apparatus in which capacitive transmission of data is effected by means of electromagnetic waves. A metal rod 72 is provided on the transmitter 3 as a transmission antenna, which extends along the transmission region 5. The receiver 7 has a probe 73 and carries this along the metal rod 72. The pulses thus received are applied through an amplifier 74.

It is evident that the foregoing disclosure will enable those skilled in the art to make numerous other uses and modifications of, and departures from the embodiments specifically described herein without departure from the spirit and scope of the present inventive concepts. The present invention is to be construed as embracing each and every novel feature and novel combination of features herein disclosed and as being limited solely by the scope and spirit of the appended claims.

I claim:

1. In a flatbed knitting machine having needles, means for actuating said needles, a stationary data source, means for transmitting data from said stationary source, at least one movable carriage, receiver means on said carriage, control means on said carriage for controlling said actuating means in accordance with data transmitted by said transmitter means and received by said receiver means, storing means on said carriage being connected between said receiver means and said control means for storing data for at least one course of knitting, and feed means for supplying electrical power to said carriage, the improvement comprising said receiver means on said carriage connected to converter means, said converter means connected to processing means being connected to said storing means and receiving signals therefrom, pulse generator means connected to said processing means being further connected to an amplifier means which is connected with said control means, said processing means on each carriage including a micro-processor for processing received data, said transmitter means being located externally of the region occupied by said needles, and means attached to said receiver means electrically screening the zone in which data is transmitted from said transmitter means to said receiver means.

2. The flatbed knitting machine of claim 1 further comprising transmission means adapted to minimise the data transmission path between said transmitter means and said receiver means.

3. The knitting machine of claim 1 further including further converter means adapted to convert data stored in said data source for transmission, and said first converter means adapted to convert data received by said receiver means into electrical pulses.

4. The knitting machine of claim 1 wherein said transmitter means and said receiver means are adapted for screened directional electromagnetic transmission and reception of data respectively.

5. The knitting machine of claim 4 further comprising a wire loop antenna associated with said transmitter means and a ferrite rod antenna associated with said receiver means.

6. The knitting machine of claim 4 further comprising a metal rod antenna associated with said transmitter means and probe antenna associated with said receiver means.

7. The knitting machine of claim 1 further comprising means adapted to switch said transmitter means on and off to effect data transmission by way of an unmodulated signal.

8. The knitting machine of claim 1 wherein said transmitter means is adapted to transmit a carrier frequency signal and said receiver means includes means tuning said receiver to respond only to the carrier frequency.

9. The knitting machine of claim 8 wherein said tuning means comprises a phase locked loop.

10. The knitting machine of claim 8 wherein said tuning means comprises active filter means.

11. The knitting machine of claim 8 wherein said transmitter means includes means for amplitude modulating said carrier frequency signal, and wherein said receiver means includes demodulator means for demodulating the modulated carrier frequency signal received thereby.

12. The knitting machine of claim 11 wherein said amplitude modulating means is adapted to separate said carrier frequency signal into discrete pulses.

13. The knitting machine of claim 8 wherein said transmitter means includes means for frequency modulating said carrier frequency signal and said receiver means includes demodulator means for demodulating the modulated carrier frequency signal received thereby.

14. The knitting machine of claim 1 wherein said transmitter means includes light source means and said receiver means includes light receiver means adapted to receive data in optical form from said transmitter means.

15. The knitting machine of claim 14 wherein said transmitter means comprises first lens means located to transmit light from said means, and wherein said receiver means comprises photoelectric means and second lens means located to transmit light to said photoelectric means.

16. The knitting machine of claim 14 wherein said transmitter means comprises means located to reflect light from said light source means and wherein said receiver means comprises photoelectric means and lens means positioned to transmit light to said photoelectric means.

17. The knitting machine of claim 14 wherein said transmitter means comprises light-bar means having minimal clearance from said receiver means.

18. The knitting machine of claim 19 further including means between said transmitter means and said receiver means providing a plurality of light transmission channels and opaque partitions therebetween.

19. The knitting machine of claim 18 wherein opaque partitions have edges adjacent said receiver means extending parallel to the direction of movement of the receiver means.

20. The knitting machine of claim 14 further comprising transmitter electronic means, said light source means being accommodated in said transmitter electronic means, receiver electronic means, said light receiver means being accommodated in said receiver electronic means, first light transmitting means extending from said light source means to a light transmission position, and second light transmitting means extending from said light receiver means to a light reception position.

21. The knitting machine of claim 14 further comprising cleaning means carried by said carriage for cleaning said transmitter means, and stationary cleaning means for cleaning said receiver means during movement thereof.

22. The knitting machine of claim 1 wherein said transmitter means is adapted to transmit and said receiver means is adapted to receive data in accoustic form.

23. The knitting machine of claim 1 wherein said carriage is movable reciprocably and wherein said transmitter means comprises two transmitters each located adjacent a respective one of the positions of reversal of carriage movement.

24. The knitting machine of claim 1 wherein said carriage is movable reciprocably and wherein said transmitter means comprises a transmitter located adjacent one of the positions of reversal of carriage movement.

25. The knitting machine of claim 1 wherein said needles comprise a plurality of needle sets, wherein said carriage is movable around a closed path, and wherein said transmitter means comprises a plurality of transmitters each located for data transmission in respect of one course of knitting by one needle set.

26. The knitting machine of claim 1 wherein said needles comprise a plurality of needle sets, wherein said carriage is movable around a closed path including a plurality of racking positions and wherein said means comprises a plurality of transmitters each located at a respective one of said racking positions for data transmission in respect of one course of knitting by both said needle sets.

27. The knitting machine of claim 1 having a plurality of said carriages, an alarm device mounted on each of said carriages, each alarm device being capable of transmission to said data source of a signal in the event of a defect occurring on the associated carriage, and means in said data source responsive to said signal to prevent transmission of data to said defective carriage and to transmit said data to the next succeeding non-defective carriage.

28. The knitting machine of claim 27 wherein said alarm device is responsive automatically to a carriage defect to transmit said signal.

29. The knitting machine of claim 27 further comprising means manually operable to cause said alarm device to transmit said signal.

30. The knitting machine of claim 1 wherein said transmitter means is adapted to transmit data in a predetermined rhythm and wherein means for generating timing signals co-ordinated with said rhythm is included in said receiver means.

31. The knitting machine of claim 1 further comprising means providing an additional channel between said transmitter means and said receiver means for transmission of timing signals.

32. The knitting machine of claim 1 further comprising means in said transmitter means for generating timing signals, means for transmitting said timing signals to said receiver means, means in said receiver means responsive to said timing signals to activate said receiver means for data reception, and further means in said receiver means for acknowledging said timing signals to said transmitter means.

* * * * *